US005139582A

United States Patent [19]

Kurosawa et al.

[11] Patent Number: 5,139,582

[45] Date of Patent: Aug. 18, 1992

[54] METHOD OF MANUFACTURING AN ORIENTED SILICON STEEL SHEET HAVING IMPROVED MAGNETIC CHARACERISTICS

[75] Inventors: Mitsumasa Kurosawa; Michiro Komatsubara; Katsuo Iwamoto; Takahiro Kan; Toshio Sadayori, all of Chiba, Japan

[73] Assignee: Kawasaki Steel Corporation, Japan

[21] Appl. No.: 757,179

[22] Filed: Sep. 10, 1991

[30] Foreign Application Priority Data

Sep. 10, 1990 [JP] Japan ..... 2-237235

[51] Int. Cl.[5] ..... C21D 8/00

[52] U.S. Cl. ..... 148/111; 148/112; 148/624

[58] Field of Search ..... 148/111, 112, 113, 12.3

[56] References Cited

U.S. PATENT DOCUMENTS 4,269,634 5/1981 Foster et al. ..... 148/113

4,318,758 3/1982 Kuroki et al. ..... 148/111

FOREIGN PATENT DOCUMENTS 0089195 9/1983 European Pat. Off. ..... 148/111

*Primary Examiner*—R. Dean

*Assistant Examiner*—Sikyin Ip

*Attorney, Agent, or Firm*—Austin R. Miller

[57] ABSTRACT

A method of manufacturing an oriented silicon steel sheet improved in magnetic characteristics, in which a hot-rolled steel sheet of oriented silicon steel containing about 0.01 to 0.10% by weight of Al and about 0.01 to 0.04% by weight of Sb as inhibitor components is heat-treated and cold-rolled one time or two or more times to have a final thickness. In the final heat treatment and final cold rolling alone, the steel sheet is quenched from a temperature of about 900° to 1,100° C. to a temperature equal to or lower than about 50° C., is heat-treated at about 50° to 150° C. for about 30 sec. to 30 min. while applying a tensile stress of about 0.5 to 20 kg/mm$^2$, is thereafter cold-rolled by a reduction rate of about 35 to 70% in a tandem rolling method, is aged at about 200° to 400° C. for about 10 sec. to 10 min., and is finished by cold rolling to have the final thickness.

2 Claims, No Drawings

METHOD OF MANUFACTURING AN ORIENTED SILICON STEEL SHEET HAVING IMPROVED MAGNETIC CHARACERISTICS

BACKGROUND OF THE INVENTION

This invention relates to a method of manufacturing an oriented silicon steel sheet having improved magnetic characteristics and, more particularly, to an improved cold rolling process which enables improvements in productivity and magnetic characteristics of the sheet.

Among magnetic characteristics of oriented silicon steel sheets, a high magnetic flux density and a low core loss are important. Recent progress of manufacture techniques has made it possible to obtain, for example, a steel sheet having a magnetic flux density $B_5$ (value at a magnetizing force of 800 A/m) of 1.92 T with respect to a thickness of 0.23 mm and also to manufacture, on an industrial scale, an improved product having a core loss characteristic $W_{17/50}$ (a value under a fully magnetized condition: 1.7 T at 50 Hz) of 0.90 w/kg.

Sheet having such an improved magnetic characteristic has a crystalline structure in which <001>directions corresponding to an axis of easy magnetization of iron are uniformly aligned with the direction of rolling of the steel sheet. Such an texture is formed during finishing annealing in an oriented silicon steel sheet manufacturing process by secondary recrystallization in which crystal grains having a (110) [001]direction called the Goss orientation are grown with priority into giant grains. As fundamental requirements for sufficiently growing secondary recrystallized grains, the existence of an inhibitor for limiting the growth of crystal grains having undesirable directions other than the (110) [001]direction in the secondary recrystallization process and the formation of a primary recrystallized texture suitable for developing secondary recrystallized grains of (110) [001]direction are required, as is well known.

A fine precipitate of MnS, MnSe, AlN or the like is ordinarily utilized as an inhibitor. Also, enhancing the effect of the inhibitor by adding a grain boundary segregation type component such as Sb or Sn to the inhibitor has been practiced, as disclosed in Japanese Patent Publication Nos. 51-13469 and 54-32412.

On the other hand, various means have conventionally been used in the steps of hot rolling and cold rolling to form a suitable primary recrystallized texture. For example, with respect to a cold rolling method using AlN as an inhibitor, it has been considered that processing the steel by the thermal effect of warm rolling or inter-pass aging during cold rolling as disclosed in Japanese Patent Publication No. 50-26493, 54-13846 or 54-29182 is particularly effective. This kind of technique is based on the idea of forming a suitable texture by using the mutual effect between solid solutions N and C and dislocations in the steel so that the mechanism of deformation of the material during rolling is changed.

However, the above-described methods of the prior art are rather disadvantageous in terms of productivity and do not always ensure the effect of obtaining an improved magnetic characteristic with stability. For example, it is still difficult to carry out warm rolling on an industrial scale for technical reasons. With respect to inter-pass aging, it is a common practice to heat-treat the steel in a coiled state a plurality of times with a one-stand reverse rolling mill, because it is very difficult to heat-treat the steel uniformly throughout the overall coil length.

A technique of using a tandem rolling mill having a plurality of rolling stands to improve productivity has recently come into popular use. Rolling using a tandem rolling mill, unlike rolling using a reverse rolling mill, requires matching of rolling ratio and the rolling speeds between preceding rolling stand and following rolling stand Naturally it mainly causes compressed deformation by compression, not by tension. The rolling deformation mechanism of this type of rolling thus differs greatly from those of other conventional rolling methods, and the effect of the conventional aging method is therefore unsatisfactory. In this situation tandem rolling for a high-magnetic-flux-density silicon steel sheet containing Al is particularly difficult. Moreover, because of characteristics of tandem rolling, the production efficiency is considerably reduced if aging is repeatedly effected, and it is undesirable to effect aging a plurality of times for the purpose of improving the productivity as in conventional methods.

SUMMARY OF THE INVENTION

In view of the above-described problems, an object of the present invention is to provide a novel method of manufacturing an oriented silicon steel sheet with improvement in magnetic characteristics and stability when using a tandem rolling mill to improve productivity.

We have studied various ways of improving magnetic characteristics of silicon steel sheets with stability and greatly improved productivity. We have found a method of manufacturing an oriented silicon steel sheet having improved magnetic characteristic by tandem rolling and aging only one time.

According to the present invention, a hot-rolled steel sheet of oriented silicon steel containing 0.01 to 0.10% by weight of Al and 0.01 to 0.04% by weight of Sb as inhibitor components is heat-treated and cold-rolled one time or two or more times to attain a final thickness and in the final heat treatment and final cold rolling alone, a) quenching the steel sheet from a temperature of 900° to 1,100° C. to a temperature equal to or lower than 50° C., and heat-treating the steel sheet at 50° to 150° C. for 30 sec. to 30 min. while applying a tensile stress of 0.5 to 20 kg/mm$^2$, b) thereafter cold-rolling the steel sheet by applying a reduction rate of 35 to 70% in a tandem rolling mill, c) aging the steel sheet at 200° to 400° C. for 10 sec. to 10 min., and d) finishing the steel sheet by cold rolling so that the steel sheet has the desired final thickness.

The present invention will be described with reference to experiments which are intended to be illustrative but not to limit the scope of the invention.

Two oriented silicon steel materials used in the experiments are:

Steel A containing 0.071% of C, 3.25% of Si, 0.072% of Mn, 0.026% of sol.Al, 0.022% of Se, 0.0086% of N, and the balance substantially Fe, and Steel B having a composition similar to that of steel A with addition of Sb, i.e., containing 0.070% of C, 3.24% of Si, 0.069% of Mn, 0.026% of sol.Al, 0.022% of Se, 0.0084 of N, 0.027% of Sb and the balance substantially Fe.

The steels A and B were, after slab reheating at 1,440° C., hot-rolled to a thickness of 2.2 mm. They were then pickled, cold-rolled to an intermediate thickness of 1.5 mm, uniformly maintained at a temperature of 1,100° C. for 90 sec. by intermediate annealing, and quenched to precipitate AlN. Quenching was effected by mist cooling from 950° C. to room temperature at an average cooling speed of 50° C./s.

Next, for comparison between the tandem rolling method and the Sendzimir rolling method, the steel sheets were rolled by the following rolling processes including one-, two- or three-time aging to reduce their thickness to a final thickness of 0.23 mm.

(A) One-time aging

The steel sheets were respectively rolled by 3-pass reverse rolling with a Sendzimir rolling mill and cold rolling with a 3-stand tandem rolling mill so that their thickness was reduced to 0.60 mm, the sheets were thereafter aged and were cold rolled by the respective rolling mills to a final thickness of 0.23 mm.

(B) Two-time aging

The steel sheets were cold rolled with the Sendzimir rolling mill and the tandem rolling mill to 1.0 and then to 0.6 mm, and were aged after each cold rolling, and thereafter, the sheets were cold rolled to a final thickness of 0.23 mm.

(C) Three-time aging

The steel sheets were cold rolled with the Sendzimir rolling mill and the tandem rolling mill to 1.0, 0.6 and 0.40 mm, and were aged after each cold rolling, and thereafter, the sheets were cold rolled to a final thickness of 0.23 mm.

Each aging step was performed at 300° C. for 2 minutes.

Thereafter the steel sheets were annealed and decarburized at 840° C. for 2 minutes in a wet hydrogen atmosphere, an annealing separator containing MgO as a main component was applied to the steel sheets, and the steel sheets were thereafter final-annealed.

The magnetic characteristics of the steel sheets thus obtained were measured. Table 1 shows the results of this measurement.

TABLE 1

| Rolling method | Types of steel | Magnetic characteristics | Number of aging times 1 time | 2 times | 3 times |
|---|---|---|---|---|---|
| Sendzimir rolling | Steel A | $B_8$ (T) | 1.885 | 1.902 | 1.921 |
| | | $W_{17/50}$ (W/Kg) | 1.16 | 1.02 | 0.98 |
| | Steel B | $B_8$ (T) | 1.889 | 1.910 | 1.926 |
| | | $W_{17/50}$ (W/Kg) | 1.14 | 1.08 | 0.95 |
| Tandem rolling | Steel A | $B_8$ (T) | 1.881 | 1.875 | 0.880 |
| | | $W_{17/50}$ (W/Kg) | 1.19 | 1.22 | 1.18 |
| | Steel B | $B_8$ (T) | 1.863 | 1.862 | 1.866 |
| | | $W_{17/50}$ (W/Kg) | 1.21 | 1.25 | 1.20 |

As shown in Table 1 the effect of improving the magnetic characteristics by tandem rolling was poorer than that in the case of Sendzimir rolling even though the number of aging times was increased.

It is to be noted here that in the case of tandem rolling the magnetic characteristics were not substantially changed as the number of aging times was increased. This result indicates that the work deformation behavior differs from that in the case of the reverse type Sendzimir rolling. Viewed from another angle, this result suggests a possibility that the magnetic characteristics can be improved by performing aging only one time in a process using tandem rolling.

Steel B to which Sb was added as an inhibitor strengthening element exhibited magnetic characteristics superior to those of steel A containing no Sb when processed by Sendzimir rolling but exhibited poorer magnetic characteristics when processed by tandem rolling. Experiments and studies were made to ascertain the cause of this phenomenon and it was thereby found that in steel B to which Sb was added fine carbide precipitates were not formed after intermediate annealing. It is believed that Sb limits precipitation of carbides to cause this phenomenon.

With respect to an oriented silicon steel material in which AlN is used as a main inhibitor, it is generally considered that quenching is necessary for precipitation of AlN. Quenching enriches the amount of solid solution C or fine carbide precipitation, which is advantageous in improving the texture through the aging during cold rolling. This was one of the reasons why quenching was indispensable. It is supposed that in steel B to which Sb is added, fine carbide precipitates are not formed and C is left almost entirely as solid solution C.

While the aging effect was constant irrespective of the existence/nonexistence of added Sb in the case of Sendzimir rolling, the magnetic characteristics of steel B having no fine carbides were deteriorated in the case of tandem rolling. This result suggests that in case of tandem rolling, solid solution C has a less effect of changing the deformation mode, but precipitated fine carbide has an advantageous effect in enhancing aging effect.

Various methods of forming fine carbide precipitates were then examined. First, steels A and B were cooled under cooling conditions (a), (b), (c), (d) and (e) shown in Table 2, were thereafter rolled to a thickness of 0.6 mm with a 3-stand tandem rolling mill, aged at 300° C. for 2 minutes in a continuous furnace, and cold-rolled to a final thickness of 0.23 mm. They were thereafter annealed and decarburized at 840° C. for 2 minutes in a wet hydrogen atmosphere, an annealing separator containing MgO as a main component was applied to the steel sheets, and the steel sheets were thereafter anneal finished.

The magnetic characteristics of the steel sheets thus obtained were measured. Table 2 shows the results of this measurement.

TABLE 2

| Cooling condition | Type of steel | Magnetic characteristics $B_8$ (T) | $W_{17/50}$ (W/Kg) | Carbide precipitation form before cold rolling |
|---|---|---|---|---|
| (a) | A | 1.850 | 1.22 | Grain boundaries precipitated |
| | B | 1.851 | 1.30 | Grain boundaries precipitated |
| (b) | A | 1.863 | 1.26 | Grain boundaries partially precipitated Average in-grain carbide length: 2000 Å |
| | B | 1.870 | 1.22 | Average in-grain carbide length: 800 Å |
| (c) | A | 1.875 | 1.19 | Average in-grain carbide length: 800 Å |
| | B | 1.882 | 1.15 | Average in-grain carbide length: 500 Å |
| (d) | A | 1.884 | 1.16 | Average in-grain carbide length: 500 Å |
| | B | 1.860 | 1.25 | Solid solution state |
| (e) | A | 1.883 | 1.15 | Average in-grain carbide length: 500 Å |

TABLE 2-continued

| Cooling condition | Type of steel | Magnetic characteristics $B_8$ (T) | $W_{17/50}$ (W/Kg) | Carbide precipitation form before cold rolling |
|---|---|---|---|---|
| | B | 1.862 | 1.23 | Solid solution state |

(a) Quenching from 950 to 400° C. at 50° C./s followed by natural cooling to room temperature
(b) Quenching from 950 to 300° C. at 50° C./s followed by natural cooling to room temperature
(c) Quenching from 950 to 200° C. at 50° C./s followed by natural cooling to room temperature
(d) Quenching from 950 to 100° C. at 50° C./s followed by natural cooling to room temperature
(e) Quenching from 950 to room temperature at 50° C./s followed by natural cooling to room temperature According to the results shown in Table 2, C is precipitated at crystal grain boundaries and carbides are not finely precipitated in crystal grains, when the cooling stop temperature is equal to or higher than 400° C. As the cooling stop temperature was reduced, the tendency of carbides to finely precipitate was increased. However, in the case of steel B to which Sb was added, carbides were again stopped from finely precipitating when quenched to a temperature not higher than 100° C. In steel B, carbides were finely precipitated at a cooling temperature of 200° to 300° C. although their density was low. It is thought that this phenomenon is age precipitation caused by the heat left in the material after termination of quenching.

After quenching the steel sheets were processed in a temperature range of 50° to 400° C. to precipitate carbides. However, no carbide precipitates having a size smaller than 500 Å were obtained. Experiments were further conducted to examine this phenomenon, and it was found that very fine carbide precipitates are formed if a tensile stress is applied during precipitation treatment.

The influences of carbide precipitation upon the magnetic characteristics were then examined by quenching the steel sheets under conditions such as those shown in Table 3 and by effecting precipitation treatments with application of tensile stress in accordance with conditions (f), (g), (h), (i) and (j).

Table 3 shows the results of examination of the magnetic characteristics of the steel sheets thus processed as well as the carbide precipitation form before cold rolling.

TABLE 3

| Cooling condition | Type of steel | Magnetic characteristics $B_8$ (T) | $W_{17/50}$ (W/Kg) | Carbide precipitation form before cold rolling |
|---|---|---|---|---|
| (f) | A | 1.882 | 1.18 | Average in-grain carbide length: 500 Å |
| | B | 1.889 | 1.16 | Average in-grain carbide length: 500 Å |
| (g) | A | 1.863 | 1.26 | Average in-grain carbide length: 1500 Å |
| | B | 1.930 | 0.92 | Average in-grain carbide length: 300 Å |
| (h) | A | 1.875 | 1.30 | Average in-grain carbide length: 2000 Å |
| | B | 1.938 | 0.84 | Average in-grain carbide length: 80 Å |
| (i) | A | 1.854 | 1.32 | Average in-grain carbide length: 2000 Å |
| | B | 1.935 | 0.88 | Average in-grain carbide length: 100 Å |
| (j) | A | 1.859 | 1.25 | Average in-grain carbide length: 2000 Å |
| | B | 1.936 | 0.85 | Average in-grain carbide length: 80 Å |

Cooling condition. quenching from 950° C. to room temperature at 60° C./s
(f) Carbide precipitation treatment at 90° C. for 2 min. with application of a tensile stress of 0.2 kg/mm² after quenching
(g) Carbide precipitation treatment at 90° C. for 2 min. with application of a tensile stress of 0.5 kg/mm² after quenching
(h) Carbide precipitation treatment at 90° C. for 2 min. with application of a tensile stress of 2.0 kg/mm² after quenching
(i) Carbide precipitation treatment at 90° C. for 2 min. with application of a tensile stress of 5.0 kg/mm² after quenching
(j) Carbide precipitation treatment at 90° C. for 2 min. with application of a tensile stress of 10.0 kg/mm² after quenching It was found that with respect to steel B fine carbide precipitates having a size smaller than 300 Å can be obtained by cooling the steel sheet to room temperature and by thereafter effecting precipitation treatment with application of a tensile stress equal to or greater than 0.5 kg/mm², and that it is thereby possible to obtain improved magnetic characteristics, as is clear from Table 3. In the case of steel A, since carbides of about 500 Å are precipitated before the precipitation treatment, finer precipitates cannot thereafter be obtained and, conversely, the carbide precipitates become coarse, resulting in deterioration in magnetic characteristics.

It was also found that even in steel B, such fine carbide precipitates become so coarse that no magnetic characteristic improving effect is exhibited when the temperature of precipitation with application of tensile stress is higher than 150° C.

The reason for this phenomenon is not clear but it is supposed that carbides are difficult to form in coexistence with Sb, and that fine carbide precipitates are not formed unless the steel sheet is treated at a low temperature not higher than 150° C. while being tensioned as described above.

Such a phenomenon could not have been anticipated and has not been suggested before the present invention.

In the case of tandem rolling, as described above, the effect of aging between cold rolling steps is increased and improved magnetic characteristics can be obtained, if with respect to the form of C the carbide precipitates are finer, that is, have a size not greater than 300 Å and are precipitated at a higher density. It was confirmed that adding Sb, quenching the steel sheet to room temperature and processing the steel sheet by precipitation at a temperature of 50° to 150° C. with application of a tensile stress equal to or greater than 0.5 kg/mm² creates a steel sheet having improved magnetic characteristics in comparison with prior sheets manufactured by tandem rolling. This has been regarded impossible by effecting aging only one time. The reason for this effect is not clear but the following explanation may be given.

In comparison between the texture of a Sendzimir-rolled sheet and a tandem-rolled sheet after decarburization annealing, the tandem-rolled sheet exhibited an increase in {111}<uvw>component while the Sendzimir-rolled sheet had {111}<112>as a main component. It is considered that in the case of Sendzimir rolling the influences of solid solution C and fine carbide precipitates upon the work deformation behavior to provide the same effects with respect to aging between cold rolling steps, and that in the case of tandem rolling the existence of fine carbide precipitates causes the work deformation behavior to change during work deformation and advantageously influences the aggregation from {111}<uvw>to {111}<112>

Intermediate annealing of the material containing AlN as an inhibitor is ordinarily effected at about 1,100° C. If the temperature at which quenching, also intended to precipitate AlN, is started is excessively high, a portion of the material changed by γ transformation during annealing tends to remain as a pearlitic structure to substantially reduce solid solution C or fine carbide precipitates. It is therefore undesirable to excessively increase the quenching start temperature.

Preferably the material of the oriented silicon steel sheet has the following composition:

C: about 0.03 to 0.10%

C is indispensable for making the crystalline structure uniform by utilizing phase transformation during hot rolling. The desired uniformizing effect cannot be obtained if the content of C is excessively small, or the time for subsequent decarburization step is considerably long if the content of C is excessively large. It is therefore preferable to set the content of C to about 0.03 to 0.10%.

Si: about 2.5 to 4.0%

The electrical resistance is reduced so that the desired core loss characteristic cannot be obtained, if the content of Si is excessively small, or it is difficult to perform cold rolling if the content of Si is excessively large. It is therefore preferable to set the Si content to about 2.5 to 4.0%.

Al: 0.01 to 0.10%, N: 0.0030 to 0.020%

Al and N have important roles as inhibitor-forming elements. Certain contents of these elements are required. However if these contents are excessive it is difficult to form fine precipitates. It is therefore preferable to limit the contents of Al and N to about 0.01 to 0.10% and about 0.0030 to 0.020%, respectively. More preferably, the Al content is about 0.01 to 0.05%.

In this case, S and/or Se may be present as inhibitor-forming elements.

S and/or Se: about 0.01 to 0.04%, Mn: about 0.05 to 0.15%

In this case the inhibitors are mainly MnS and/or MnSe. The range of S or Se suitable for finely precipitating MnS or MnSe is about 0.01 to 0.04% in either case of using one or both of S and Se. If the content of Mn is excessively large, Mn cannot be maintained in solution. It is preferable to set the Mn content to the range of about 0.05 to 0.15%.

Sb: about 0.01 to 0.04%.

Sb is an important element in accordance with the present invention. Fine carbide precipitation cannot be controlled if the content of Sb is excessively small, or surface defects of the product are increased if the Sb content is excessively large. Sb is therefore added in the range of about 0.01 to 0.04%.

Inhibitor strengthening elements, such as Cu, Sn, B, Ge and the like, other than the above-mentioned elements may be added as desired to improve magnetic properties. The contents of such elements may be set to well-known ranges. For prevention of surface defects due to hot embrittlement, addition of Mo at about 0.005 to 0.020% is preferred.

A well-known method is applied to the process of manufacturing this oriented silicon steel material. An ingot or slab thereby manufactured is re-rolled and formed in accordance with the desired size, and is thereafter heated and hot rolled. After hot rolling, the steel strip is heat-treated and cold-rolled one time or two or more times to obtain a final thickness.

In cooling in the annealing step before final cold rolling, quenching from 900° C. at the lowest is required for the purpose of uniformly precipitating AlN. However, if the quenching start temperature is excessively high, the γ phase tends remain as a pearlitic structure. The quenching start temperature is therefore controlled to about 900° to 1,100° C.

If the cooling speed is excessively low AlN is not uniformly precipitated and precipitation of carbides to grain boundaries also takes place. If the cooling speed is excessively high the amount of remaining pearlitic structure is increased or a defect of steel sheet shape is caused easily. It is preferable to set the cooling rate to about 20° to 100° C./s.

It is important to set the cooling stop temperature to a range such that carbides are not finely precipitated during cooling. If Sb is contained as in the present invention, it is necessary to set this temperature to about 50° C. or lower.

If the temperature of the subsequent fine carbide precipitation treatment is excessively low, fine carbide precipitates are not formed, or if the treatment temperature is excessively high, carbides are not finely precipitated and the density thereof is reduced. According to the present invention, therefore, the treatment temperature is limited to the range of about 50° to 150° C. If the precipitation treatment time is too short precipitates are not sufficiently formed, or if the precipitation treatment time is excessive productivity is reduced. The precipitation treatment time is therefore controlled to about 30 sec. to 30 min. In the case of cooling in an oxidizing atmosphere the precipitation treatment may be effected together with pickling.

In the precipitation treatment the effect of finely precipitating carbides is unsatisfactory if the applied tensile stress is smaller than about 0.5 kg/mm$^2$. It is therefore necessary to set the applied tensile stress to about 0.5 kg/mm$^2$ or greater. The tensile stress may applied to the steel strip by using a tension roll or the like. If the applied tensile stress is excessive the equipment size is considerably increased. It is therefore preferable to set the tensile stress to about 20 kg/mm$^2$ or smaller.

At the time of tandem rolling before final cold rolling the steel sheet is rolled by a reduction rate of about 35 to 70% before aging, and short-time heat treatment is effected for aging in a temperature range of about 200° to 400° C. for 10 sec. to 10 min. The steel sheet is successively cold-rolled to have the final thickness. Cold rolling for finishing to the final thickness may be either by tandem rolling or Sendzimir rolling. The reason for setting the conditions of the final cold rolling step in the above-mentioned ranges is that the aging effect is not sufficient if the reduction rate of tandem rolling before aging is outside the above-mentioned range. If the aging time and temperature are outside of the above-mentioned ranges the aging effect is also unsatisfactory. Preferably continuous heat treatment is effected as the aging treatment whereby the steel strip is improved in uniformity in the longitudinal direction. If a steel to which Sb has been added is rolled by tandem rolling, performing such aging only one time may suffice. In this respect the method of the present invention differs greatly from the prior art.

If the final sheet thickness is small, ordinary annealing at about 1,100° to 1,200° C. and intermediate cold rolling based on Sendzimir rolling or tandem rolling are performed the necessary number of times and the method of the present invention is applied to the step of finishing to the final sheet thickness.

The rolled steel strip is annealed and decarburized by any well-known method, an annealing separator having MgO as a main constituent is applied to the steel strip, and the steel strip is coiled and undergoes finishing annealing. An insulating coating is thereafter formed on the steel strip if necessary. Needless to say, the steel strip may be further processed to refine magnetic domains by a laser, plasma, an electron beam or any other means.

EXAMPLE 1

Molten steel for making oriented silicon steel containing 0.070% of C, 3.28% of Si, 0.074% of Mn, 0.002% of P, 0.025 of S, 0.025% of Sb, 0.024% of sol.Al, 0.0087% of N, 0.012 of Mo and the balance substantially Fe was prepared and was formed as a slab by continuous casting. The slab was heated by high-temperature short-time heating at 1,420° C. for 20 minutes and was thereafter hot-rolled to form a coil of hot-rolled sheet having a thickness of 2.2 mm. The steel sheet was then uniformly maintained at 1,150° C. for 90 sec. for annealing, gradually cooled to 950° C., quenched to room temperature at a rate of 70° C./s, and subjected to a carbide precipitation treatment in a hot water bath at 85° C. for 5 min. while being tensioned by a tensile stress of 3.5 kg/mm$^2$. The steel sheet was thereafter tandem-cold-rolled by each of the reduction rates shown in Table 4, was heat-treated for aging in a hot blast aging furnace at 300° C. for 3 min., and was successively cold-rolled with a tandem rolling mill to a final thickness of 0.30 mm.

Next, the steel sheet was subjected to decarburization/primary recrystallization annealing at 840° C. for 5 minutes, an annealing separator containing MgO as a main component was applied to the steel sheet, and the steel sheet was subjected to finishing annealing at 1,200° C.

The magnetic characteristics of the steel sheets thereby obtained were measured. Table 4 shows the results of this measurement.

TABLE 4

| Reduction rate of cold rolling before aging (%) | Magnetic characteristics $B_8$ (T) | $W_{17/50}$ (W/Kg) | Note |
|---|---|---|---|
| 5 | 1.814 | 1.46 | Comparative example |
| 20 | 1.878 | 1.35 | Comparative example |
| 35 | 1.936 | 0.99 | Example of the invention |
| 55 | 1.941 | 0.97 | Example of the invention |
| 70 | 1.933 | 1.00 | Example of the invention |
| 80 | 1.881 | 1.34 | Comparative example |

The results show that the magnetic characteristics of the steel sheets of the present invention manufactured by setting the reduction rate of cold rolling before aging within the range of 35 to 70% are superior than those of comparative examples manufactured by using a reduction rate out of this range.

EXAMPLE 2

Molten steel for forming oriented silicon steel containing 0.072% of C, 3.32% of Si, 0.069% of Mn, 0.002 of P, 0.002% of S, 0.021% of Se, 0.025% of Sb, 0.024% of sol.Al, 0.07% of Cu, 0.0085% of N, 0.013% of Mo and the balance substantially Fe was prepared and was formed as a slab by continuous casting. The slab was heated by high-temperature short-time heating at 1,420° C. for 20 minutes and was thereafter hot-rolled to form a coil of hot-rolled sheet having a thickness of 2.2 mm. The steel sheet was then cold-rolled so that the thickness was reduced to 1.5 mm, subjected to intermediate annealing at 1,100° C. for 60 sec., thereafter gradually cooled to 950° C., quenched to room temperature at a rate of 50° C./s, and subjected to a carbide precipitation treatment in a hot water bath at 100° C. for 3 min. while being tensed by a tensile stress of 2.0 kg/mm$^2$. The steel sheet was thereafter tandem-cold-rolled by a reduction rate of 50 heat-treated for aging in a hot-blast aging furnace under each of the conditions shown in Table 5 and successively cold-rolled with a tandem rolling mill to have a final thickness of 0.23 mm.

Next, the steel sheet was subjected to decarburization/primary recrystallization annealing at 840° C. for 5 minutes, an annealing separator containing MgO as a main component was applied to the steel sheet, and the steel sheet was subjected to finishing annealing at 1,200° C.

The magnetic characteristics of the steel sheets thereby obtained were measured. Table 5 shows the results obtained.

TABLE 5

| Aging heat treatment condition | Magnetic characteristics $B_8$ (T) | $W_{17/50}$ (W/Kg) | Note |
|---|---|---|---|
| 150° C. × 3 min. | 1.826 | 1.40 | Comparative example |
| 200° C. × 3 min. | 1.930 | 0.89 | Example of the invention |
| 300° C. × 3 min. | 1.942 | 0.82 | Example of the invention |
| 400° C. × 3 min. | 1.936 | 0.87 | Example of the invention |
| 450° C. × 3 min. | 1.863 | 1.31 | Comparative example |
| 300° C. × 5 s | 1.852 | 1.33 | Comparative example |
| 300° C. × 10 s | 1.931 | 0.88 | Example of the invention |
| 300° C. × 60 s | 1.935 | 0.84 | Example of the invention |
| 300° C. × 10 min. | 1.934 | 0.80 | Example of the invention |
| 300° C. × 20 min. | 1.892 | 0.98 | Comparative example |

The results show that the magnetic characteristics of the steel sheets of the present invention manufactured by controlling the aging heat treatment temperature to the range of about 200° to 400° C. and the aging time to the range of about 10 sec. to 10 min. are superior than those of comparative examples manufactured by setting the corresponding factors out of these ranges.

EXAMPLE 3

Molten steel for making oriented silicon steel containing 0.075% of C, 3.30% of Si, 0.071% of Mn, 0.002% of P, 0.001 of S, 0.019% of Se, 0.025% of Sb, 0.027% of sol.Al, 0.07 of Cu, 0.0090% of N, 0.012% of Mo and the balance substantially Fe was prepared and was formed as a slab by continuous casting. The slab was heated by high-temperature short-time heating at 1,420° C. for 20 minutes and was thereafter hot-rolled to form a coil of hot-rolled sheet having a thickness of 2.2 mm. The steel sheet was then cold-rolled so that the thickness was reduced to 1.5 mm, uniformly maintained at 1,100° C. for 60 sec. for intermediate annealing, thereafter gradually cooled to 950° C., quenched to room temperature at a rate of 40° C./s, and subjected to a carbide precipitation treatment in a hydrochloric acid bath at 80° C. under each of the conditions shown in Table 6 for pickling as well while being tensed by a tensile stress of 1.5 kg/mm$^2$. The steel sheet was thereafter tandem-cold-rolled by a reduction rate of 55%, heat-treated for aging in a hot-blast aging furnace at 300° C. for 2 min. and successively cold-rolled with reverse rolling mill to have a final thickness of 0.23 mm.

Next, the steel sheet was subjected to decarburization/primary recrystallization annealing at 840° C. for 5 minutes, an annealing separator containing MgO as a main component was applied to the steel sheet, and the steel sheet was subjected to finishing annealing at 1,200° C.

The magnetic characteristics of the steel sheets thereby obtained were measured. Table 6 shows the results of this measurement.

TABLE 6

| Precipitating time | Magnetic characteristics $B_8$ (T) | $W_{17/50}$ (W/Kg) | Note |
|---|---|---|---|
| 10 s | 1.892 | 1.02 | Comparative example |
| 30 s | 1.935 | 0.86 | Example of the invention |
| 60 s | 1.940 | 0.82 | Example of the invention |
| 5 min. | 1.945 | 0.78 | Example of the invention |
| 10 min. | 1.938 | 0.84 | Example of the invention |
| 30 min. | 1.937 | 0.83 | Example of the invention |
| 60 min. | 1.932 | 0.88 | Comparative example |

The results show that the magnetic characteristics of the steel sheets of the present invention manufactured by setting the precipitation treatment temperature to about 80° C. and the precipitation treatment time to the range of about 30 sec. to 30 min. while applying a tensile stress of 1.5 kg/mm$^2$ are superior than those of comparative examples manufactured by setting the corresponding factors out of these ranges.

EXAMPLE 4

Molten steel for forming oriented silicon steel containing 0.072% of C., 3.33% of Si, 0.065% of Mn, 0.002 of P, 0.001% of S, 0.022% of Se, 0.027% of Sb, 0.026% of sol.Al, 0.07% of Cu, 0.0092% of N, 0.011% of Mo and the balance substantially Fe was prepared and was formed as a slab by continuous casting. The slab was heated by high-temperature short-time heating at 1,430° C. for 15 minutes and was thereafter hot-rolled to form a coil of hot-rolled sheet having a thickness of 2.0 mm. The steel sheet was then cold-rolled so that the thickness was reduced to 1.2 mm, subjected to intermediate annealing at 1,150° C. for 60 sec., thereafter quenched from the quenching start temperature in accordance with each of the conditions shown in Table 7 to room temperature at a rate of 60° C./s, and successively subjected to a carbide precipitation treatment in a hot water bath at 80° C. for 5 min. while being tensed by a tensile stress of 4.5 kg/mm$^2$. The steel sheet was thereafter tandem-cold-rolled by a reduction rate of 50%, heat-treated for aging in a hot-blast aging furnace at 300° C. for 2 min. and successively cold-rolled with a reverse rolling mill to have a final thickness of 0.18 mm.

Next, the steel sheet was subjected to decarburization/primary recrystallization annealing at 840° C. for 3 minutes an annealing separator containing MgO as a main component was applied to the steel sheet, and the steel sheet was subjected to finishing annealing at 1,200° C.

The magnetic characteristics of the steel sheets thereby obtained were measured. Table 7 shows the results of this measurement.

TABLE 7

| Quenching start temperature (°C.) | Magnetic characteristics $B_8$ (T) | $W_{17/50}$ (W/Kg) | Note |
|---|---|---|---|
| 1150 | 1.865 | 1.02 | Comparative example |
| 1100 | 1.925 | 0.95 | Example of the invention |
| 1050 | 1.931 | 0.81 | Example of the invention |
| 1000 | 1.940 | 0.77 | Example of the invention |
| 950 | 1.938 | 0.79 | Example of the invention |
| 900 | 1.927 | 0.83 | Example of the invention |
| 850 | 1.892 | 0.99 | Comparative example |
| 800 | 1.861 | 1.01 | Comparative example |

The results show that the magnetic characteristics of the steel sheets of the present invention manufactured by setting the quenching start temperature in the range of about 900° to 1,100° C. are superior than those of comparative examples manufactured by setting the corresponding factor out of this range.

As described above, according to the present invention, an oriented silicon steel sheet having improved magnetic characteristic can be manufactured with stability even in a case where tandem rolling is performed for the purpose of improving the productivity.

What is claimed is:

1. In a method of manufacturing an oriented silicon steel sheet having improved magnetic characteristics, in which a hot-rolled steel sheet of oriented silicon steel containing about 0.01 to 0.10% by weight of Al and about 0.01 to 0.04% by weight of Sb as inhibitor components is both heat-treated and cold-rolled until the steel sheet has a predetermined thickness, wherein the improvement comprises:

quenching the steel sheet from a temperature of about 900 to 1,100° C. to a temperature equal to or lower than about 50° C., and heat-treating the steel sheet at about 50° to 150° C. for 30 sec. to 30 min. while applying a tensile stress of about 0.5 to 20 kg/mm$^2$;

thereafter cold-rolling the steel sheet at a reduction of about 35 to 70% in a tandem rolling mill;

aging the steel sheet at about 200° to 400° C. for about 10 sec. to 10 min.; and finishing the steel sheet by cold rolling so that the steel sheet has a predetermined final thickness.

2. In a method of manufacturing an oriented silicon steel sheet having improved magnetic characteristics, in which a hot-rolled steel sheet of oriented silicon steel containing about 0.01 to 0.10% by weight of Al and about 0.01 to 0.04% by weight of Sb as inhibitor components is both heat-treated and cold-rolled until the steel sheet has a predetermined thickness, wherein the improvement comprises:

quenching the steel sheet from a temperature of about 900° to 1,100° C. to a temperature equal to or lower than about 50° C., wherein the speed of cooling is about 20°-100° C./s, and heat-treating the steel sheet at about 50° to 150° C., for 30 sec. to 30 min. while applying a tensile stress of about 0.5 to 20 $kg/mm^2$;

thereafter cold-rolling the steel sheet at a reduction of about 35 to 70% in a tandem rolling mill;

aging the steel sheet at about 200° to 400° C. for about 10 sec. to 10 min.; and finishing the steel sheet by cold rolling so that the steel sheet has a predetermined final thickness.

* * * * *

UNITED STATES PATENT AND TRADEMARK OFFICE

CERTIFICATE OF CORRECTION

PATENT NO. : 5,139,582

DATED : August 18, 1992

INVENTOR(S) : Mitsumasa Kurosawa et al

It is certified that error appears in the above-identified patent and that said Letters Patent is hereby corrected as shown below:

In Column 1, line 17, please change "$B_s$" to --$B_8$--.

In Column 3, Table 1, under column heading "Number of aging times" under subheading "3 times", fifth line down, please change "0.880" to --1.880--.

In Column 4, Table 2, under heading "Magnetic Characteristics", under subheading "$W_{17/50}$ (W/Kg)" line 1, please change "1.22" to --1.33--.

Signed and Sealed this

Sixth Day of July, 1993

Attest:

Michael K. Kirk

MICHAEL K. KIRK

Attesting Officer

Acting Commissioner of Patents and Trademarks